US005538397A

United States Patent [19]

Laufer et al.

[11] Patent Number: 5,538,397

[45] Date of Patent: Jul. 23, 1996

[54] FUEL INJECTION PUMP

[75] Inventors: Helmut Laufer, Gerlingen; Anton Karle, Villingen, both of Germany

[73] Assignee: Robert Bosch GmbH, Stuttgart, Germany

[21] Appl. No.: 125,921

[22] Filed: Sep. 23, 1993

Related U.S. Application Data

[63] Continuation of Ser. No. 877,167, filed as PCT/DE/00903, Nov. 24, 1990.

[30] Foreign Application Priority Data

Dec. 29, 1989 [DE] Germany ..... 39 43 245.9

[51] Int. Cl.[6] ..... F02M 51/00

[52] U.S. Cl. ..... 417/53; 417/278

[58] Field of Search ..... 417/278, 53

[56] References Cited

U.S. PATENT DOCUMENTS 2,741,088 4/1956 Andrews ..... 417/278 X
4,476,835 10/1984 Laufer .
4,793,313 12/1988 Paganon ..... 123/506
5,127,381 7/1992 Kupzik et al. .

FOREIGN PATENT DOCUMENTS 3436768 4/1986 Germany .
3507853 9/1986 Germany .

*Primary Examiner*—Richard E. Gluck
*Attorney, Agent, or Firm*—Michael J. Striker

[57] ABSTRACT

A fuel injection pump has a pump plunger (13), which is driven by a drive shaft (15) via a cam gear (14) at least in an axial stroke movement and in so doing generates a fuel injection pressure in a pump work space (16), and a magnet valve (30) blocking or releasing the pump work space (16) relative to a relief duct (26). The start of delivery of the pump plunger is determined by the closing of the relief duct (26) and the end of delivery of the pump plunger (13) is determined by the release of the relief duct (26). To prevent the so-called jumping off of the plunger in the cam gear (14), the magnet valve (30) is controlled after the end of delivery in such a way that a residual pressure lying below the injection pressure is built up in the pump work space (16) until the top dead center point is reached (FIG. 1).

5 Claims, 1 Drawing Sheet

FUEL INJECTION PUMP

This is a continuation of application Ser. No. 07/877,167, filed as PCT/DE90/00903 Nov. 24, 1990.

BACKGROUND OF THE INVENTION

The present invention relates to a fuel injection pump for internal combustion engines.

More particularly, it relates to a fuel injection pump with a pump work space connected with at least one pressure line, with a pump plunger defining the pump work space and producing a fuel injection pressure in at least one pressure line by an axial stroke movement, with rotating drive shaft driving the pump plunger to execute at least the stroke movement by means of a cam gear, with a relief duct connected with the pump wall space, with a magnet valve which controls the relief duct, determines the start of the delivery of the pump plunger and the end of a delivery, and with a control device for controlling the magnet valve.

Such a fuel injection pump is known e.g. from DE 35 07 853 A1 or DE 34 36 768. In such fuel injection pumps a so-called jumping off of the pump plunger occurs at high speeds, i.e. the cam or eccentric disk of the cam gear unit which is connected with the pump plunger so as to be fixed with respect to rotation relative to it and whose end face carries the cams or protuberances is no longer adequately pressed with its end face against the rollers of the roller ring of the cam gear unit by-the contact pressure spring so that the stroke curve of the pump plunger is no longer exact in relation to the rotational position of the drive shaft. Accordingly, faultless functioning of the fuel injection pump is ensured only until approaching the so-called limit speed, which may not be exceeded. Such fuel injection pumps are therefore preferably used in slow-running diesel engines.

SUMMARY OF THE INVENTION

Accordingly, it is an object of the present invention to provide a fuel injection pump for internal combustion engines, which avoids the disadvantages of the prior art.

In keeping with these objects and with others which will become apparent hereinafter, one feature of the present invention resides, briefly stated, in a fuel injection pump for internal combustion engines, which has a pump work space connected with at least one pressure line, a pump plunger defining the pump work space producing a fuel injection pressure in at least one pressure line, a rotating drive shaft driving the pump plunger to execute at least a stroke movement, a relief duct connected with the pump work space and a magnet valve controlling the relief duct and determining the start of the delivery and the end of the delivery of the pump plunger, and a control device for controlling the magnet valve, wherein in accordance with the present invention the magnet valve is controlled at the end of delivery in such a way that residual pressure lying below the injection pressure is maintained in the pump work space.

When the fuel injection pump is designed in accordance with the present invention, it has the advantage that the drive shaft can be driven at higher speeds in the range of the limit speed without the risk of the pump plunger lifting off the cam gear unit. As a result of the residual pressure maintained in the pump work space after the end of injection, which residual pressure lies below the injection pressure and accordingly does not influence the fuel injection and the amount of fuel injected, a counterforce is exerted on the pump plunger which presses the eccentric disk on the rollers with increased contact pressure and reliably prevents a jumping off of the pump plunger at higher speeds.

The residual pressure lying below the injection pressure can be maintained in various ways according to advisable embodiment forms of the invention.

In a first embodiment form of the invention after the exciting current to the magnet valve has been switched off at the end of injection a control current is applied again to the magnet valve, which control current is of a magnitude such that the electromagnetic force generated by it is not capable of completely closing the magnet valve so that fuel can flow out of the pump work space in a throttled manner via the relief duct which is only partially closed; that is, the pressure in the pump work space which has dropped below injection pressure slowly decreases.

In an alternative embodiment form of the invention, after the exciting current is removed at the end of injection and after the consequent sudden drop in pressure in the pump work space below the injection pressure, the magnet valve is excited again by current pulses. The magnet valve is partially or completely closed for the duration of a current pulse and partially or completely opened in the pulse intervals so that the mean residual pressure in the pump work space likewise only decreases slowly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
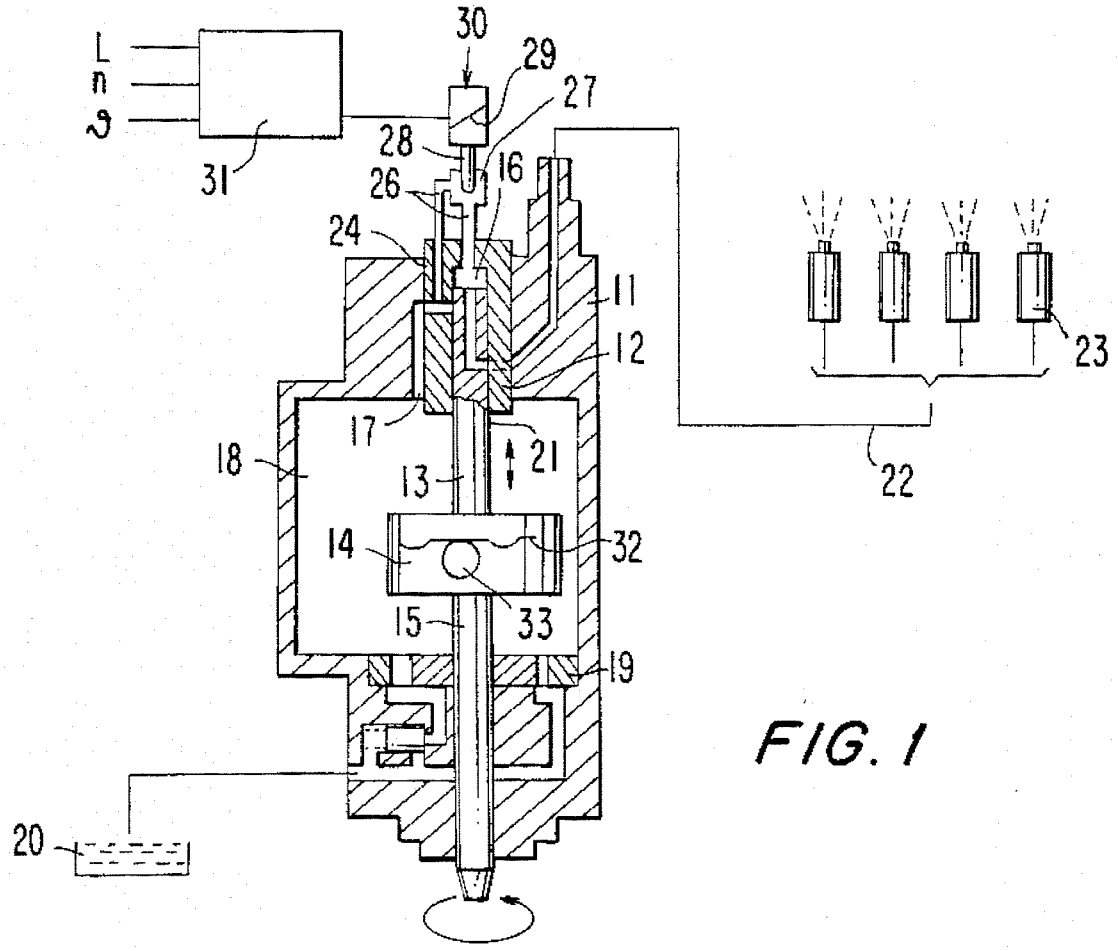
FIG. 1 shows a longitudinal section of a fuel injection pump in a schematic view.

In the fuel injection pump shown in longitudinal section and schematically in FIG. 1, a bushing 12 is arranged in a pump housing 11. A pump plunger 13 which serves simultaneously as a distributor executes a reciprocating and simultaneously rotating motion in the bushing 12. The pump plunger 13 is driven by a cam gear unit 14 of a drive shaft 15 which rotates synchronously with the speed of the internal combustion engine supplied with fuel by the injection pump. A pump work space 16 which is connected with a pump interior space 18 in the pump housing 11 via a supply duct is defined by the end face of the pump plunger 13 and the bushing 12. The pump interior space 18 is supplied with fuel from a fuel tank 20 via a delivery pump 19. The fuel is distributed to pressure lines 22 from the pump work space 16 via a distributor groove 21 in the pump plunger 13 in the corresponding rotational position of the pump plunger 13. The pressure lines 22 lead to injection nozzles 13 at the internal combustion engine via the bushing 12 and the pump housing 11. In the end area of the pump plunger 13 facing the pump work space 16, longitudinal grooves 24 which open toward the end face and accordingly toward the pump work space 16 are provided at the pump plunger 13. The longitudinal grooves 24 produce a connection between the supply duct 17 and the pump work space 16 during the suction stroke of the pump plunger 13. A relief duct 26 which is guided to the suction side of the pump plunger 13 and opens into the supply duct 17 branches off from the pump work space 16 at a location which cannot be influenced by the pump plunger 13. A valve seat 27 is located in the relief duct 26. A valve closing element 28 which is actuated by an electromagnet 29 cooperates with the valve seat 27. The valve seat 27, valve closing element 28 and electromagnet 29 are part of a magnet valve 30 which opens or closes the cross section of the relief duct 26 after the excitation of the electromagnet 29. An electronic control device 31 which generates a control current as a function of different operating parameters of the internal combustion engine such as load L, speed n, temperature θ etc. serves to control the magnet valve 30.

Figure 2:
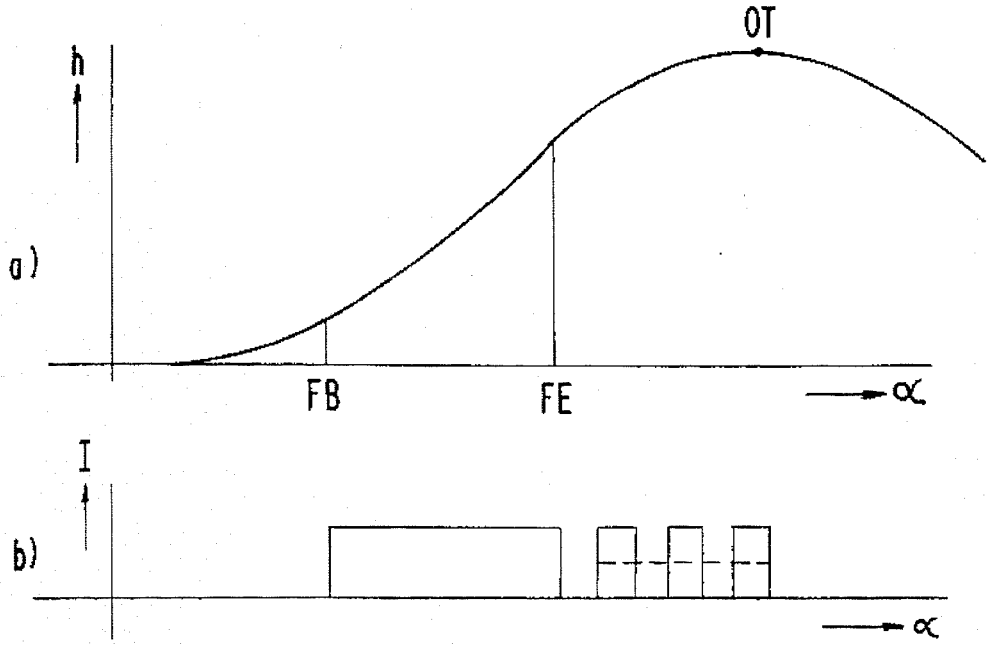
FIG. 2 shows a diagram of the stroke h of the pump plunger of the fuel injection pump in FIG. 1 as a function of the angle α of rotation of the drive shaft (FIG. 2*a*) and an associated diagram of the control of the magnet valve (FIG. 2*b*).

The magnet valve 30 and the control device 31 determine the start and end of injection of the fuel injection pump in a known manner during the delivery stroke of the pump plunger 13. In the unexcited state of the magnet valve 30 the valve closing element 28 is lifted by the valve seat 27 and the relief duct 26 is accordingly opened so that an injection pressure sufficient for opening the injection nozzles 23 is not built up in the pump work space 16. The valve closing element 28 is pressed on the valve seat 27 by exciting the magnet valve 30, characterizing the start FB of delivery, and pressure is built up in the pump work space 16. Instead of the pump work space being filled via the longitudinal grooves 24 it is also possible and advantageous here for the filling to be carried out via the relief duct 26 when the magnet valve 30 is opened in the suction stroke. Fuel is delivered to the injection nozzles 23 via the distributor groove 21 and injected into the respective combustion chamber of the internal combustion engine. The cessation of the excitation of the magnet valve 30 signifies the end FE of delivery, since this causes the valve seat 27 to be opened completely and the pressure drops in the pump work space 16. In the period between the start FB of delivery, that is the excitation of the magnet valve 30, and the end FE of delivery, that is the cessation of excitation of the magnet valve 30, an amount of fuel is injected into the combustion chambers of the internal combustion engine via the injection nozzles 13. This injected amount of fuel represents a partial quantity of the maximum possible amount of fuel delivered during a delivery stroke of the pump plunger 13. FIG. 2*a* shows the stroke curve h of the pump plunger 13 as a function of the angle α of rotation of the drive shaft 15. The start FB and end FE of delivery are plotted. FIG. 2b shows the control current applied to the magnet valve 30. The start FB and end FE of delivery coincide with the pulse edges of the control current.

The cam gear unit 14, which is known per se, is only indicated schematically in FIG. 1. On one hand it has a claw coupling which connects the drive shaft 15 and pump plunger 13 so that the latter are fixed with respect to rotation relative to one another and simultaneously allows a stroke movement of the pump plunger 13. On the other hand it has an end cam or eccentric disk 32 which is securely connected with the pump plunger 13 and is pressed on rollers 33 of a roller ring held in the pump housing 11 concentrically relative to the drive axle 15 by a pressure spring, not shown here. The configuration of the protuberances or end cams on the end face of the eccentric disk 32 determines the axial stroke of the pump plunger 13.

The maximum speed of the drive shaft 15 is determined by the so-called limit speed. When the speed exceeds this limit or is close to the said limit, the pump plunger 13 jumps off the car gear 14, i.e. the eccentric disk 32 is no longer sufficiently firmly pressed against the rollers 33 and the fixed assignment between the rotational position of the drive shaft 15 and the axial stroke of the pump plunger 13 (compare FIG. 2*a*) is no longer ensured. To prevent such a jumping off of the pump plunger 13 the magnet valve 30 is controlled by the control device 31 after the end FE of delivery in such a way that a residual pressure lying below the injection pressure is maintained in the pump work space 16 until near the top dead center OT of the pump plunger 13. This residual pressure acts in the axial direction on the pump plunger 13 and increases the contact pressure force of the eccentric disk 32 at the rollers 33, the eccentric disk 32 being securely connected with the pump plunger 13. This increased contact pressure reliably prevents the pump plunger 13 from jumping off and shifts the limit speed to higher speeds. This residual pressure lying below the injection pressure is produced in that the magnet valve 30 is controlled by the control device 31 with a plurality of control pulses after the end of delivery, as is shown in FIG. 2b. Every control pulse causes a partial or complete closing of the magnet valve 30 for its duration so that a mean pressure lying below the injection pressure is built up in the low speed range of the pump plunger 13 near the top dead center OT.

Instead of a pulsed control of the magnet valve 30 for successive and only partial opening and closing, the control current applied to the magnet valve 30 can also be continuous and of such magnitude that the force brought about by it is sufficient for displacing the valve closing element 28 in the direction of the valve seat 27 for only partial closing of the magnet valve 30. Accordingly, fuel can flow off into the supply duct 17 via the relief duct 26 only in a throttled manner during the plunger stroke remaining after the end of delivery so that a residual pressure lying below the injection pressure is generated by the remaining plunger stroke of the pump plunger 13. The control current applied to the magnet valve 30 is indicated in dashed lines in FIG. 2*b*.

It will be understood that each of the elements described above, or two or more together, may also find a useful application in other types of constructions differing from the types described above.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for internal combustion engines, comprising a fuel injection nozzle; a pump interior space which is filled with fuel and has supply pressure; a pump work space; a cam gear unit; a reciprocable pump plunger driven by said cam gear unit; a pressure conduit through which said pump plunger during its delivery stroke supplies fuel with a fuel injection pressure from said pump work space to said fuel injection nozzle; a supply duct through which said pump work space is connected with said pump interior space during a suction stroke of said pump plunger;

a relief duct through which said pump work space is unloadable; a magnet valve controlling said relief duct so that a start of delivery of said pump plunger is determined by closing of said relief duct and an end of delivery of said pump plunger is determined by opening of said relief duct by said magnet valve; and a control device for controlling said magnet valve so that after the end of delivery a residual pressure in said pump work space is smaller than said fuel injection pressure and greater than said pressure in said pump interior space, said residual pressure resulting in force loading of said pump plunger onto said cam gear unit even after the end of delivery.

2. A fuel injection pump as defined in claim 1, wherein said magnet valve is connectable again with a control current after the end of delivery, which control current is of a magnitude such that an electromagnetic force generated by said control current is sufficient only for partial closing of said magnet valve.

3. A fuel injection pump as defined in claim 1, wherein said magnet valve is controlled after the end of delivery until close to a top dead center of said pump plunger stroke.

4. A method of operating a fuel injection pump, comprising the steps of supplying a fuel with a fuel injection pressure from a pump work space to a fuel injection nozzle through a pressure conduit during a delivery stroke of a pump plunger driven by a cam gear unit; connecting the pump work space during a suction stroke of the pump plunger through a supply duct with a pump interior space which is filled with fuel and has a supply pressure; unloading the pump work space through a relief duct controlled by a magnet valve; determining a start of delivery of a pump plunger by blocking the relief duct with the magnet valve and determining an end of delivery of the pump plunger by opening the relief duct with the magnet valve; and controlling the magnet valve by a control device so that after the end of a delivery a residual pressure in the pump work space is built up by reclosing said magnet valve after having been opened for determining said end of a delivery of fuel at fuel injection pressure to such a degree that said residual pressure is smaller than said fuel injection pressure and greater than said supply pressure in the pump interior space and able to load said pump plunger so that it is held onto said cam gear unit even after the end of delivery in counter-balance to inertia forces to which the pump plunger is subjected when being driven by said cam gear unit; and connecting the magnet valve again with a control current after the end of delivery which control current is of a magnitude such that the electromagnetic force generated by it is sufficient only for a partial closing of the magnet valve.

5. A method of operating a fuel injection pump, comprising the steps of supplying a fuel with a fuel injection pressure from a pump work space to a fuel injection nozzle through a pressure conduit during a delivery stroke of a pump plunger driven by a cam gear unit; connecting the pump work space during a suction stroke of the pump plunger through a supply duct with a pump interior space which is filled with fuel and has a supply pressure; unloading the pump work space through a relief duct controlled by a magnet valve; determining a start of delivery of a pump plunger by blocking the relief duct with the magnet valve and determining an end of delivery of the pump plunger by opening the relief duct with the magnet valve; controlling the magnet valve by a control device so that after the end of a delivery a residual pressure in the pump work space is built up by reclosing said magnet valve after having been opened for determining said end of a delivery of fuel at fuel injection pressure to such a degree that said residual pressure is smaller than said fuel injection pressure and greater than said supply pressure in the pump interior space and able to load said pump plunger so that it is held onto said cam gear unit even after the end of delivery in counter-balance to inertia forces to which the pump plunger is subjected when being driven by said cam gear unit; and controlling the magnet valve by a plurality of control pulses after the end of delivery, each of which causes at least partial closing of the magnet valve for its duration, said controlling being performed after the end of delivery until close to a top dead center of a pump plunger stroke.

* * * * *